US008375756B2

(12) United States Patent
Braun et al.

(10) Patent No.: US 8,375,756 B2
(45) Date of Patent: Feb. 19, 2013

(54) AUTOMATED EDGE PEENER APPARATUS

(75) Inventors: Theodore J. Braun, Brush Prairie, WA (US); Clifford J. Chambers, Portland, OR (US); Robert E. Orth, Washougal, WA (US); Rory S. Olson, Oregon City, OR (US); Bert Kopke, Portland, OR (US); Vinh Q. Tran, Beaverton, OR (US); Hali T. Diep, Renton, WA (US)

(73) Assignee: The Boeing Company, Chicago, IL (US)

( * ) Notice: Subject to any disclaimer, the term of this patent is extended or adjusted under 35 U.S.C. 154(b) by 1012 days.

(21) Appl. No.: 12/401,517

(22) Filed: Mar. 10, 2009

(65) Prior Publication Data

US 2010/0229613 A1 Sep. 16, 2010

(51) Int. Cl.
*C21D 7/06* (2006.01)

(52) U.S. Cl. ..... 72/53

(58) Field of Classification Search ..... 72/53; 29/90.7; 219/128, 60 R–60 A
See application file for complete search history.

(56) References Cited

U.S. PATENT DOCUMENTS

| | | | | |
|---|---|---|---|---|
| 3,423,976 | A * | 1/1969 | Burney et al. | 72/53 |
| 3,566,644 | A * | 3/1971 | Moore | 72/53 |
| 3,626,539 | A * | 12/1971 | Armey | 72/53 |
| 3,834,200 | A | 9/1974 | Winter | |
| 5,549,768 | A | 8/1996 | Mahoney | |
| 5,727,995 | A | 3/1998 | Harkins | |

* cited by examiner

*Primary Examiner* — Teresa M Ekiert
(74) *Attorney, Agent, or Firm* — Hanley, Flight & Zimmerman, LLC

(57) ABSTRACT

An automated edge peener apparatus includes a peener housing, a slide carried by the peener housing, a shotpeener mechanism carried by the slide and a shot recovery system communicating with the shotpeener mechanism.

13 Claims, 4 Drawing Sheets

AUTOMATED EDGE PEENER APPARATUS

TECHNICAL FIELD

The present disclosure relates to shotpeening of wing skins in the fabrication of aircraft. More particularly, the present disclosure relates to an automated edge peener apparatus which is suitable for peening edges of wing skins.

BACKGROUND

During the fabrication of aircraft wing skins, tooling tabs may be provided on the skins to facilitate tool handling and placement. After the majority of manufacturing steps have been completed on a wing skin, the tooling tabs may be removed from the wing skin. This step may expose several areas on the wing skin which have not been subjected to a shotpeening process. Completion of the fabrication process may require that these unprocessed areas on the wing skin be subjected to shotpeening.

Conventional shotpeening methods may include masking of the wing skin, clamping of the shotpeen fixture to the portion of the wing skin which is to be processed and then manual application of the shotpeening process to the wing skin using a mobile blasting system. This process, however, may require that masking be applied at each area on the skin which is exposed by each removed tab. The shotpeening operator may be required to move heavy shotpeening equipment to each exposed area. The process may not be repeatable from one area to another on the wing skin due to operator techniques. The weight and design of the shotpeening equipment may render the equipment awkward to operate.

Therefore, an automated edge peener apparatus which is ergonomic, requires reduced set-up time and is amenable to increased process control may be desirable for some applications.

SUMMARY

The present disclosure is generally directed to an automated edge peener apparatus. An illustrative embodiment of the apparatus includes a peener housing, a slide carried by the peener housing, a shotpeener mechanism carried by the slide and a shot recovery system communicating with the shotpeener mechanism.

In some embodiments, the automated edge peener apparatus may include a peener housing; a slide carried by the peener housing; at least one rail carried by the peener housing; a shotpeener mechanism carried by the slide and the at least one rail; a pair of adjustable clamp bars carried by the peener housing; and a shot recovery system communicating with the shotpeener mechanism.

In some embodiments, the automated edge peener apparatus may include a peener housing; at least one handle carried by the peener housing; a slide carried by the peener housing; a seal plate carried by the peener housing in spaced-apart relationship to the slide; a pair of adjustable clamp bars carried by the peener housing; and a shotpeener mechanism comprising a mechanism housing carried by the slide and the seal plate, a shot conduit rotator carried by the mechanism housing, a shot conduit pivot support carried by the mechanism housing in spaced-apart relationship to the shot conduit rotator; a shot conduit extending through the shot conduit rotator and the shot conduit pivot support and having an air inlet and a shotpeen nozzle spaced-apart from the air inlet; and a shot recovery system communicating with the mechanism housing and the shot conduit.

In some embodiments, the automated edge peener apparatus may include a peener housing; a pair of handles carried by the peener housing; a slide carried by the peener housing; a seal plate carried by the peener housing in spaced-apart relationship to the slide; a pair of adjustable clamp bars carried by the peener housing; a handle switch carried by at least one of the pair of handles and operably engaging the pair of adjustable clamp bars for opening and closing of the pair of adjustable clamp bars; and a shotpeener mechanism comprising a mechanism housing carried by the slide and the seal plate and having a shot reservoir; a shot conduit rotator carried by the mechanism housing; a rotator motor carried by the peener housing and drivingly engaging the shot conduit rotator; a shot conduit pivot support carried by the mechanism housing in spaced-apart relationship to the shot conduit rotator; a shot conduit extending through the shot conduit rotator and the shot conduit pivot support and having an air inlet and a shotpeen nozzle spaced-apart from the air inlet; and a shot recovery system having a shot tube communicating with the shot reservoir and the shot conduit between the air inlet and the shotpeen nozzle; and a fixed limit switch and an adjustable limit switch carried by the peener housing on respective sides of the peener mechanism.

BRIEF DESCRIPTION OF THE ILLUSTRATIONS

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention, which is defined by the claims. Furthermore, there is no intention to be bound by any expressed or implied theory presented in the preceding technical field, background, brief summary or the following detailed description.

Figure 1:
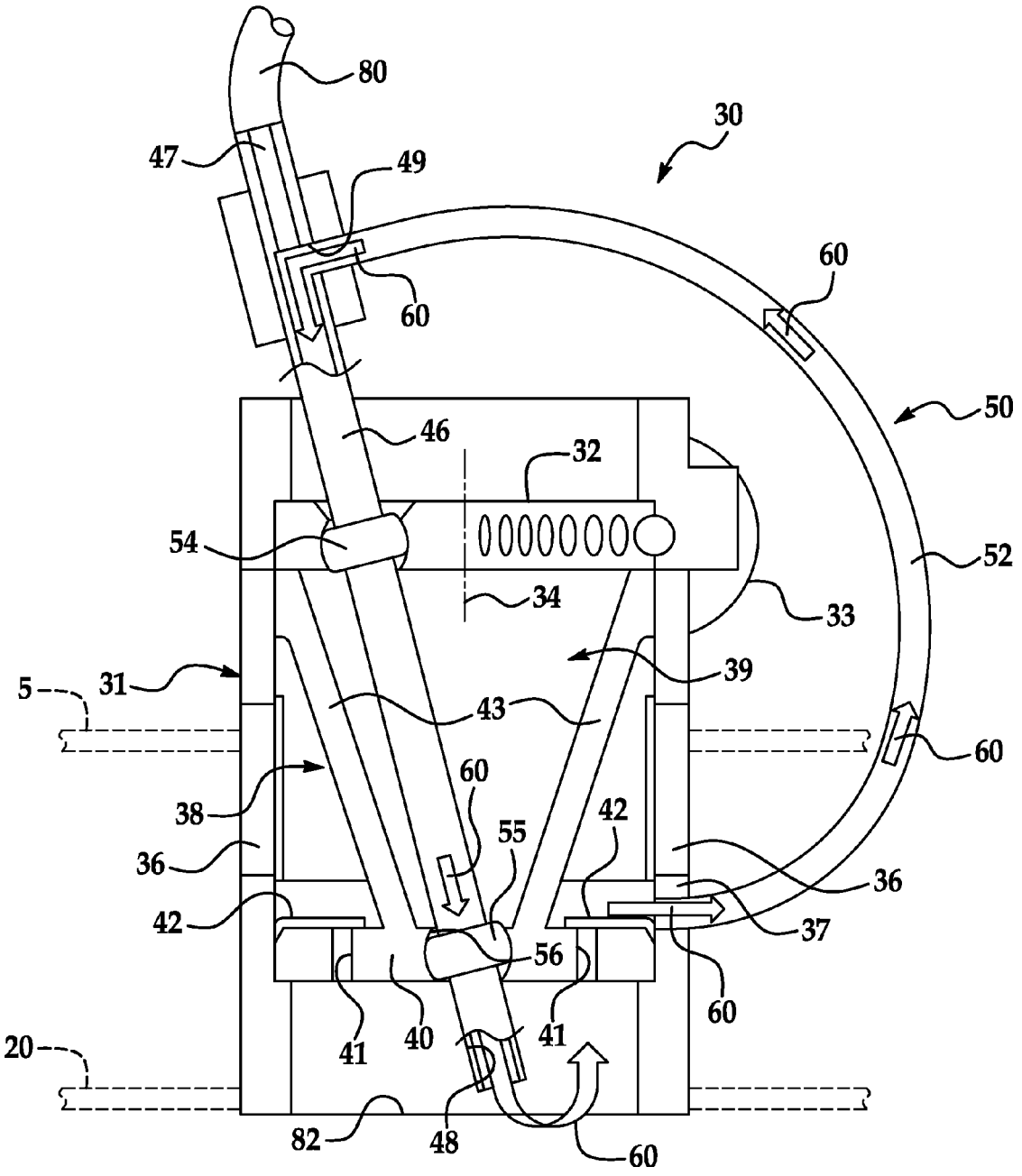
FIG. 1 is schematic view illustrating operation of an illustrative embodiment of the automated edge peener apparatus.
Figure 2:
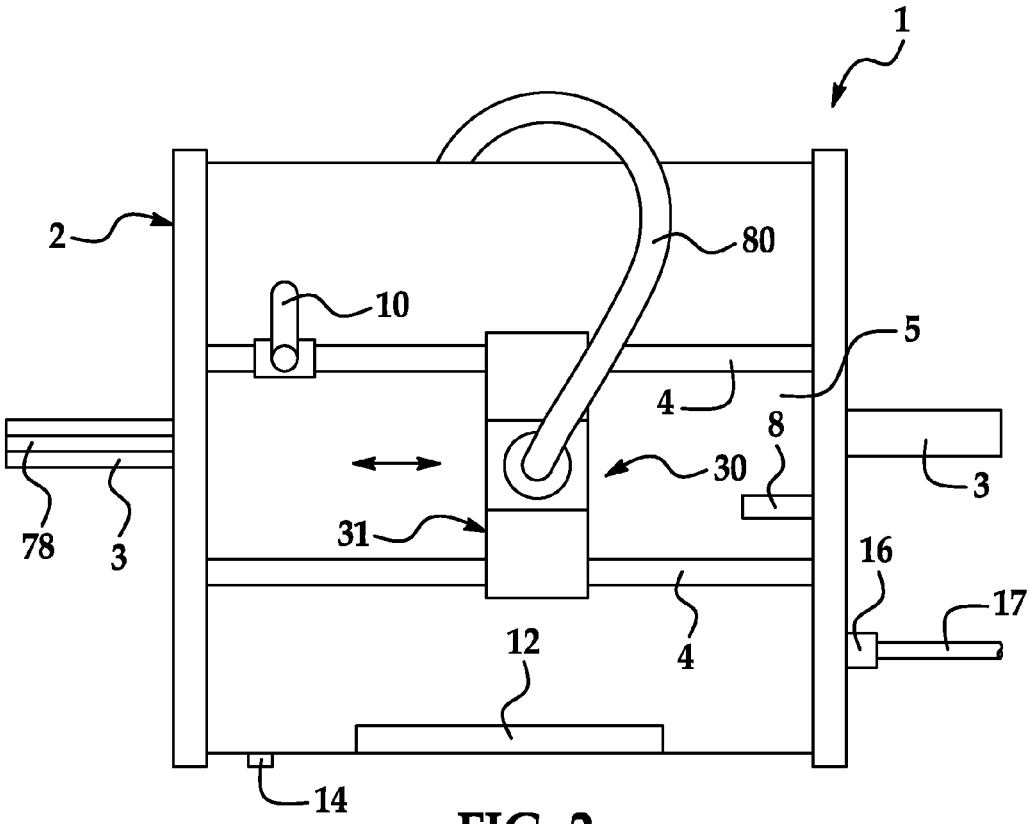
FIG. 2 is a partially schematic top view of an illustrative embodiment of the automated edge peener apparatus.
Figure 3:
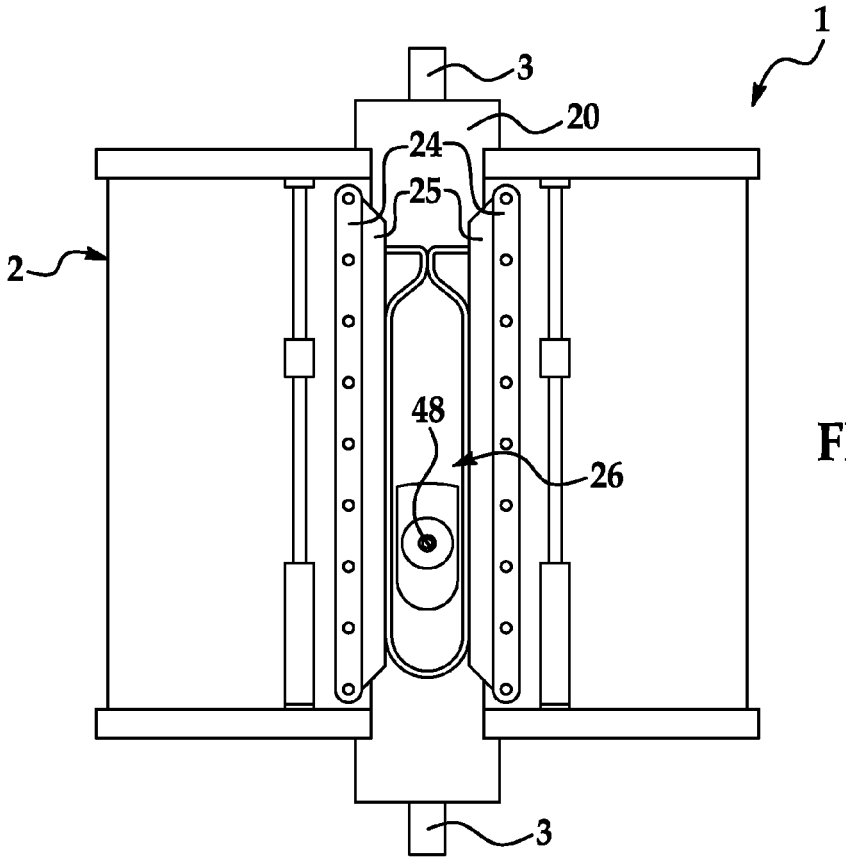
FIG. 3 is a partially schematic bottom view of an illustrative embodiment of the automated edge peener apparatus.

Referring to FIGS. 1-3, an illustrative embodiment of the automated edge peener apparatus is generally indicated by reference numeral 1 in FIGS. 1 and 2. The automated edge peener apparatus 1 may include a peener housing 2. A pair of handles 3 may extend from opposite ends of the peener housing 2. A pair of generally elongated, parallel, spaced-apart rails 4 may be provided in the peener housing 2 for purposes which will be hereinafter described. A slide 5 may be slidably mounted in the peener housing 2 generally beneath the rails 4. A fixed limit switch 8 may be provided between the rails 4 at one end of the peener housing 2. An adjustable limit switch 10 may be provided on one of the rails 4 generally at or adjacent to the other end of the peener housing 2. Counters 12 may be provided on the peener housing 2 for purposes which will be hereinafter described. An air inlet port 16 may be provided on the peener housing 2. In operation of the automated edge peener apparatus 1, which will be hereinafter described, an air inlet conduit 17 which is connected to an air source (not shown) may be coupled to the air inlet port 16.

As shown in FIG. 3, a seal plate 20 may be slidably mounted in the peener housing 2 generally beneath and in spaced-apart relationship with respect to the slide 5 (FIG. 2). A pair of generally elongated, parallel, spaced-apart clamp bars 24 may be provided on the peener housing 2 generally beneath and in spaced-apart relationship with respect to the seal plate 20. A pair of clamp seals 25 may extend inwardly toward each other from the respective clamp bars 24. A gap 26 may be defined between the clamp seals 25.

As shown in FIG. 1, a shotpeener mechanism 30 may include a mechanism housing 31 which may extend through housing openings (not shown) provided in the slide 5 and the seal plate 20, respectively. As shown in FIG. 2, in some embodiments, the mechanism housing 31 may slidably engage one or both of the rails 4. A shot conduit rotator 32 may be provided in the mechanism housing 31 and may be rotatable on a rotator bearing 35 provided in the mechanism housing 31. A rotator motor 33 may be provided on the mechanism housing 31 and may drivingly engage the shot conduit rotator 32 through a rotator gear 34 to rotate the shot conduit rotator 32 in the mechanism housing 31.

A shot conduit pivot support 40 may be provided in the mechanism housing 31 generally beneath or in spaced-apart relationship with respect to the shot conduit rotator 32. A generally funnel-shaped partition 43 may extend generally between the shot conduit rotator 32 and the shot conduit pivot support 40. The partition 43 may divide the interior of the mechanism housing 31 into an outer shot reservoir 38 and an inner conduit chamber 39. In some embodiments, at least one exhaust vent 36 may be provided in the peener housing 2 at the shot reservoir 38.

A generally elongated shot conduit 46 may extend through a conduit rotation bearing 54 provided in the shot conduit rotator 32 and through the conduit chamber 39 and a conduit pivot bearing 55 provided in a pivot opening 56 in the shot conduit pivot support 40, respectively. An air inlet 47 may be provided in a first end of the shot conduit 46. A shotpeen nozzle 48 may be provided in a second end of the shot conduit 46.

As shown in FIG. 1, the automated edge peener apparatus 1 may include a shot recovery system 50 which may be adapted to recover shot 60 from a surface 82 which is to be peened using the apparatus 1 as will be hereinafter described. The shot recovery system 50 may include a shot inlet 49 provided in the shot conduit 46 between the air inlet 47 and the shotpeen nozzle 48. In some embodiments, the shot inlet 49 may be between the air inlet 47 and the conduit rotation bearing 54. A shot outlet 37 may be provided in the peener housing 2 in communication with the shot reservoir 38. A shot tube 52 may connect the shot outlet 37 in the peener housing 2 to the shot inlet 49 in the shot conduit 46.

Figure 4:
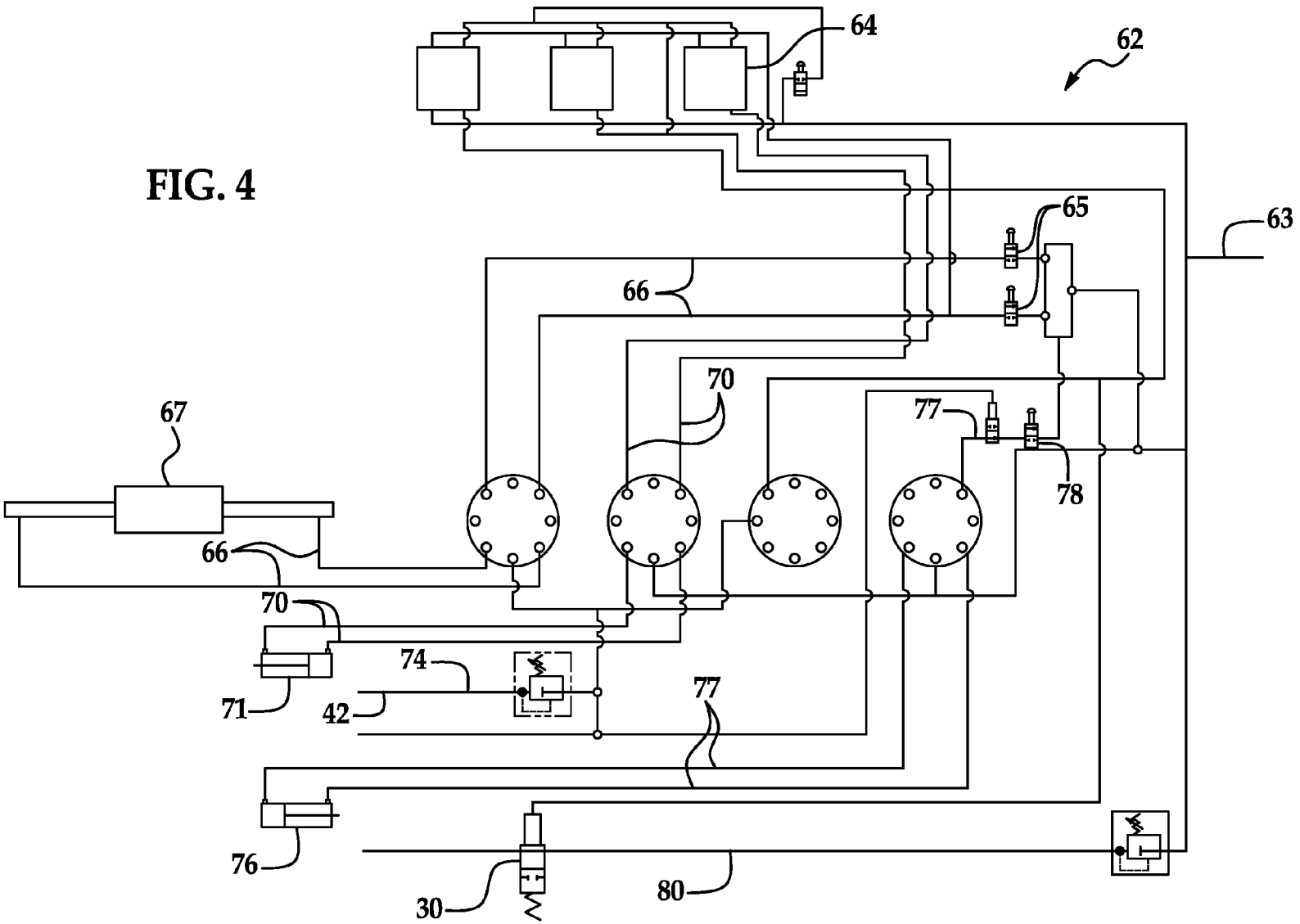
FIG. 4 is a schematic diagram of a control system for an illustrative embodiment of the automated edge peener apparatus.

Referring next to FIG. 4, an illustrative control system 62 which is suitable for implementation of an illustrative embodiment of the automated edge peener apparatus 1 is shown. The control system 62 may include an air supply 63 which may be pneumatically connected to the air inlet port 16 (FIG. 2) on the peener housing 2 via the air inlet conduit 17. A control switch 14 (FIG. 2) provided on the peener housing 2 may control flow of air from the air supply 63 into the air inlet port 16. Multiple relays 64 may be pneumatically connected to the air supply 63. A motion cylinder control switch 65 may be pneumatically connected to the relays 64. Motion cylinder lines 66 may pneumatically connect the motion cylinder control switch 65 to a motion cylinder 67. The motion cylinder 67 may operably engage the slide 5 (FIG. 2) of the automated edge peener apparatus 1 to move the slide 5 back and forth between the fixed limit switch 8 and the adjustable limit switch 10 responsive to manipulation of the motion cylinder control switch 65. The fixed limit switch 8 and the adjustable limit switch 10 may be connected to the motion cylinder 67 to limit the distance the slide 5 travels in the peener housing 2. Shot switch lines 70 may pneumatically connect the relays 64 to a shot switch 71 the opening and closing of which may control flow of shot 60 from the shot reservoir 38 through the shot tube 52. A bladder line 74 may pneumatically connect the relays to the bladder 42 in the shot reservoir 38 (FIG. 1). Clamp mechanism lines 77 may connect the relays 64 to a clamp mechanism 76 which may be adapted to open and close the clamp bars 24 (FIG. 3). In some embodiments, a handle switch 78 may be provided in the clamp mechanism lines 77 and provided on at least one of the handles 3 (FIGS. 2 and 3) to facilitate opening of the clamp bars 24 via the clamp mechanism 76 by gripping of the handles 3. A shotpeener line 80 may pneumatically connect the relays 64 to the air inlet 47 (FIG. 1) in the shot conduit 46 of the shotpeener mechanism 30.

In typical operation, the automated edge peener apparatus 1 may be used to peen an area or areas on a surface 82 (FIG. 1) such as a wing skin (not shown), for example and without limitation. In some applications, the surface 82 may have been a surface on the wing skin which was previously covered by tooling tabs during processing of the skin, for example and without limitation. Accordingly, the air supply 63 (FIG. 4) may be pneumatically connected to the air inlet port 16 (FIG. 2) of the automated edge peener apparatus 1 through the air inlet conduit 17. A supply of shot 60 (FIG. 1) may be placed in the shot reservoir 38 of the shotpeener mechanism 30. An operator (not shown) may grasp the handles 3 and open the clamp bars 24 (FIG. 3) via actuation of the handle switch 78. The automated edge peener apparatus 1 may then be placed in location and the handles 3 released such that the panel (not shown) the surface of which is to be peened may be clamped between the clamp seals 25 on the clamp bar 24. The length of the area on the surface which is to be peened may be accommodated by moving the adjustable limit switch 10 (FIG. 2) along the rail 4.

The peening process may be started by actuation of the control switch 14. This may cause the motion cylinder 67 (FIG. 4) to move the slide 5 and the shotpeener mechanism 30 back and forth between the fixed limit switch 8 and the adjustable limit switch 10 for a set number of passes. As shown in FIG. 1, as air flows from the shotpeener line 80 and through the shot conduit 46, air pressure in the shot tube 52 drops due to the Venturi effect. Consequently, air pressure in the shot reservoir 38 drops and shot 60 flows from the shot reservoir 38, through the shot outlet 37 and the shot tube 52 and into and through the shot conduit 46 through the shot inlet 49. The shot 60 traverses the shot conduit 46 and is expelled from the shotpeen nozzle 48 against the surface (not shown) to be peened. The reduced air pressure in the shot reservoir 38 draws the shot 60 back into the shot reservoir 38 through the shot return port or ports 41 past the shot retention bladder 42. From the shot reservoir 38, the shot 60 may be drawn back through the shot tube 52 and shot conduit 46, respectively, and may again be ejected from the shotpeen nozzle 48 in a continuous process.

After the number of passes required to achieve the desired intensity and saturation on the peened surface is complete, flow of shot from the shot reservoir 38 through the shot tube 52 may be stopped. For a preset number of passes of the slide 5 and shotpeener mechanism 30 between the fixed limit switch 8 and the adjustable limit switch 10, air may continue to flow from the shotpeener line 80 through the shot conduit 46, shotpeen nozzle 48, shot return port or ports 41, shot reservoir 38 and shot tube 52, respectively, of the shot recovery system 50. The resulting drop in pressure may vacuum any remaining shot back into the shot reservoir 38 through the shot return port or ports 41. Finally, flow of air to the automated edge peener apparatus 1 may be shut off, the automated edge peener apparatus 1 moved to the next area which requires peening and the process repeated.

Figure 5:
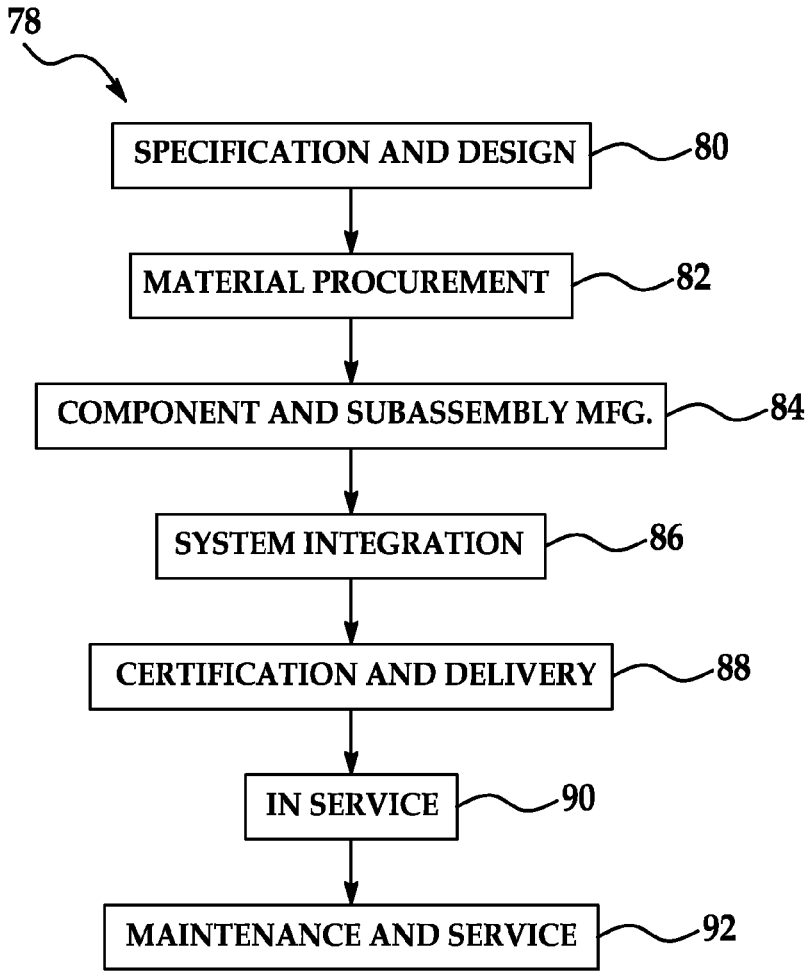
FIG. 5 is a flow diagram of an aircraft production and service methodology.
Figure 6:
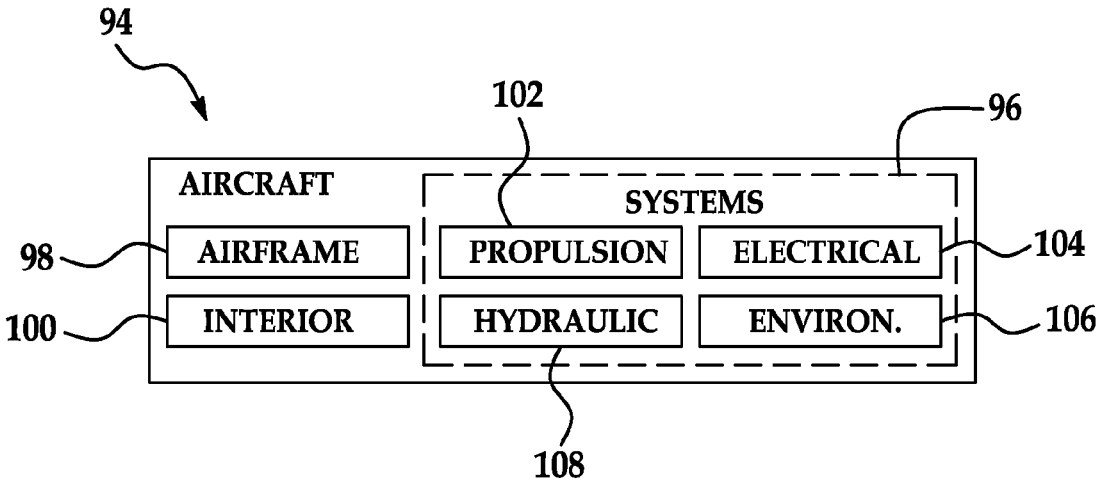
FIG. 6 is a block diagram of an aircraft.

Referring next to FIGS. 5 and 6, embodiments of the disclosure may be used in the context of an aircraft manufacturing and service method 78 as shown in FIG. 5 and an aircraft 94 as shown in FIG. 6. During pre-production, exemplary method 78 may include specification and design 80 of the aircraft 94 and material procurement 82. During production, component and subassembly manufacturing 84 and system integration 86 of the aircraft 94 takes place. Thereafter, the aircraft 94 may go through certification and delivery 88 in order to be placed in service 90. While in service by a customer, the aircraft 94 may be scheduled for routine maintenance and service 92 (which may also include modification, reconfiguration, refurbishment, and so on).

Each of the processes of method 78 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 6, the aircraft 94 produced by exemplary method 78 may include an airframe 98 with a plurality of systems 96 and an interior 100. Examples of high-level systems 96 include one or more of a propulsion system 102, an electrical system 104, a hydraulic system 106, and an environmental system 108. Any number of other systems may be included. Although an aerospace example is shown, the principles of the invention may be applied to other industries, such as the automotive industry.

The apparatus embodied herein may be employed during any one or more of the stages of the production and service method 78. For example, components or subassemblies corresponding to production process 84 may be fabricated or manufactured in a manner similar to components or subassemblies produced while the aircraft 94 is in service. Also one or more apparatus embodiments may be utilized during the production stages 84 and 86, for example, by substantially expediting assembly of or reducing the cost of an aircraft 94. Similarly, one or more apparatus embodiments may be utilized while the aircraft 94 is in service, for example and without limitation, to maintenance and service 92.

Although the embodiments of this disclosure have been described with respect to certain exemplary embodiments, it is to be understood that the specific embodiments are for purposes of illustration and not limitation, as other variations will occur to those of skill in the art.

What is claimed is:

1. An apparatus, comprising:
a frame;
a slide carried by the frame;
a shotpeener carried by the slide;
a clamp carried by the frame to clamp the frame onto a component, the component having a surface to be peened; and
a switch carried by a handle to operably engage a pair of adjustable bars of the clamp to open or close the adjustable bars.

2. The apparatus of claim 1 wherein the handle is coupled to the frame.

3. The apparatus of claim 1 further comprising a seal plate carried by the frame, the seal plate being spaced-apart from the slide.

4. The apparatus of claim 1 wherein the shotpeener comprises a housing carried by the slide and a shot conduit provided in the housing, the shot conduit having an inlet and a nozzle.

5. The apparatus of claim 1 further comprising a shot recovery system to receive shot expelled from the shotpeener.

6. The apparatus of claim 1 further comprising a first limit switch and a second limit switch carried by the frame on respective sides of the shotpeener.

7. An apparatus, comprising:
a frame;
a shotpeener movably coupled to the frame, the shotpeener to expel a shot to peen a surface of a component;
a clamp carried by the frame, the clamp to clamp the frame to the component;
a shot recovery system to recover the shot expelled via the shotpeener;
a handle carried by the frame; and
a switch carried by the handle to operably engage a pair of adjustable bars of the clamp to open or close the adjustable bars.

8. The apparatus of claim 7 further comprising a seal plate, wherein the shotpeener is coupled to the clamp and the seal plate.

9. The apparatus of claim 7 wherein the shotpeener comprises a housing carried by the slide and a shot conduit provided in the housing, the shot conduit having an air inlet and a nozzle spaced-apart from the air inlet.

10. The apparatus of claim 9 further comprising a shot reservoir to receive shot expelled from the nozzle via the shot recovery system.

11. The apparatus of claim 7 further comprising a first limit switch and a second limit switch on respective sides of the shotpeener.

12. An apparatus, comprising:
a frame;
a slide carried by the frame;
a shotpeener carried by the slide;
a clamp carried by the frame to clamp the frame onto a component, the component having a surface to be peened; and
a seal plate, wherein the shotpeener is coupled to the clamp and the seal plate.

13. An apparatus, comprising:
a frame;
a shotpeener movably coupled to the frame, the shotpeener to expel a shot to peen a surface of a component;
a clamp carried by the frame, the clamp to clamp the frame to the component;
a shot recovery system to recover the shot expelled via the shotpeener; and
a seal plate, wherein the shotpeener is coupled to the clamp and the seal plate.

* * * * *